United States Patent [19]

Dalmau

[11] 4,032,134

[45] June 28, 1977

[54] SHEET TURNING MACHINE

[75] Inventor: Juan Salvat Dalmau, Barcelona, Spain

[73] Assignee: Salvat Editores, S.A., Barcelona, Spain

[22] Filed: Dec. 10, 1975

[21] Appl. No.: 639,609

[30] Foreign Application Priority Data

June 12, 1974 Spain ..... 203898

[52] U.S. Cl. ..... 271/5; 271/94; 271/98; 271/30 R; 271/186; 271/195; 271/213; 271/217

[51] Int. Cl.[2] ..... B65H 3/10; B65H 29/24

[58] Field of Search ..... 271/5, 4, 3, 6, 7, 186, 271/65, 184, 195, 217, 213, 98, 94, 30 R

[56] References Cited

UNITED STATES PATENTS

| | | | |
|---|---|---|---|
| 2,195,545 | 4/1940 | Stobb | 271/5 X |
| 2,384,768 | 9/1945 | Rau | 271/3 X |
| 2,645,479 | 7/1953 | Mitchell | 271/94 X |
| 3,046,008 | 7/1962 | Velvel | 271/186 |
| 3,103,355 | 9/1963 | Hubbard et al. | 271/5 |
| 3,572,686 | 3/1971 | Day | 271/94 X |

*Primary Examiner*—John J. Love
*Assistant Examiner*—Bruce H. Stoner, Jr.
*Attorney, Agent, or Firm*—Wenderoth, Lind & Ponack

[57] ABSTRACT

A sheet turning machine includes two slidable platforms, one of which is ascending while the other is descending, the upward travel of one of the platforms being synchronized with the downward travel of the other platform. The ascending platform is arranged between two vertical guide columns solidly fastened to a fixed chassis, while the descending platform is guided between two columns solidly fastened to a frame which tilts about the fixed chassis. The ascending platform is arranged under the field of action of a suction pump. A turning bridge is arranged above the descending platform and includes an endless conveyor belt which has a lower or return run part which diverges in a direction perpendicular to the columns guiding the descending platform. At the front of a roller whereat the endless belt returns, there is an air generator capable of maintaining a sheet of paper fixed to the belt while the sheet, travelling with the belt, passes from the upper run to the lower or return run.

3 Claims, 5 Drawing Figures

SHEET TURNING MACHINE

BACKGROUND AND SUMMARY OF THE INVENTION

The present invention relates to a sheet turning machine, which is considerably improved with respect to other devices existing in the market and having similar end purposes.

The machine of the invention includes two platforms which slide along a support chassis. One of the platforms ascends while the other descends, the movement of the two being synchronized. The ascending platform is arranged under the field of action of a suction pump which actuates movement of the sheets of paper and which is coplanar with a turning device arranged above the descending platform and including an endless conveyor belt. An air generator is provided to maintain the sheet of paper fixed to the belt.

With this machine a rapid and efficient turning of the sheets is obtained. It is well known that in the graphic arts there is continual need for a device for turning sheets of paper. Two such needs are when the sheet is to be printed on both sides thereof, and when paper coming from the warehouse is to be aired. Taking into account the size and weight of the sheets, for large-scale production many hours of manual labor are necessary. Further, it is necessary that the sheets should not be folded and that the sheets should be arranged in a perfect line.

These problems, as well as other similar problems with which publishing companies are faced, are overcome with great efficiency and ease by the machine of the invention.

BRIEF DESCRIPTION OF THE DRAWINGS

Other features of the invention will be apparent from the following description thereof, taken with reference to the attached drawings wherein.

DETAILED DESCRIPTION OF THE INVENTION

Figure 1:
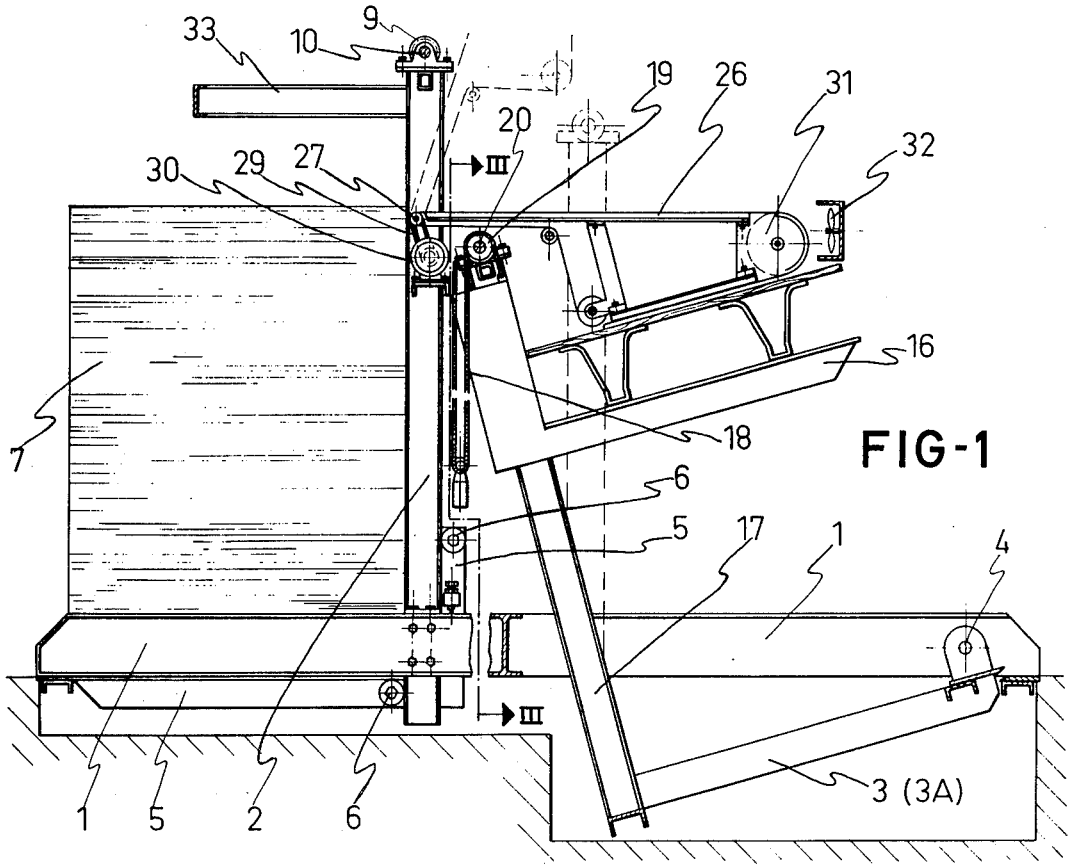
FIG. 1 is an elevational view of the machine of the invention.
Figure 2:
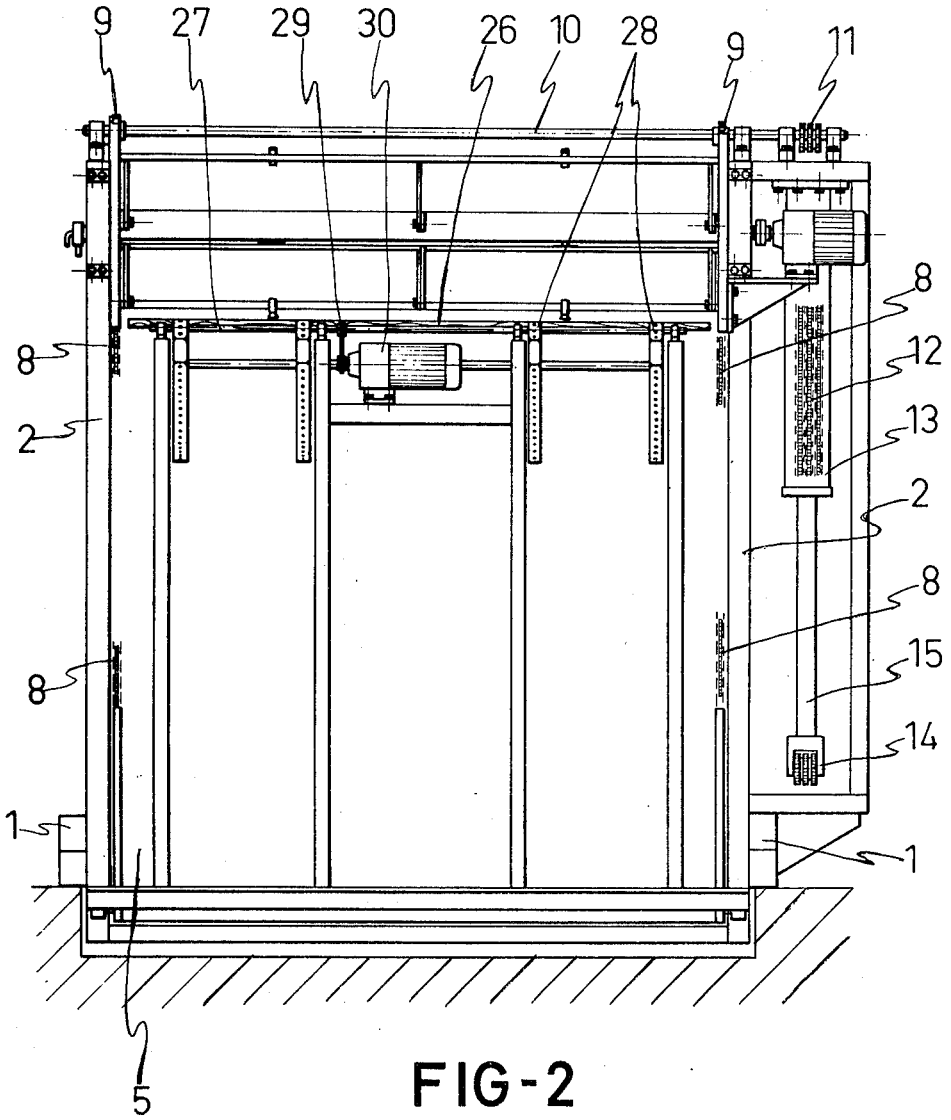
FIG. 2 is a side view illustrating the lowering and raising mechanism of the ascending platform, as well as a different view of the turning system.

The drawings illustrate a fixed chassis 1 having extending upwardly therfrom fixed vertical columns 2. A tilting frame 3 is pivoted about pins 4 attached to chassis 1. Along the columns 2 slides an ascending platform 5, guided by rollers or bearings 6, which ascending platform 5 supports a stack 7 of sheets which are to be turned by the machine of the invention.

The ascending platform 5 is suspended by chains 8 which mesh with pinions 9 solidly fixed to a shaft 10 which is solidly fixed to a triple gear 11 meshing with a triple chain 12. Chain 12 is driven by the movement of a hydraulic cylinder 13 by means of the triple pinion 14 solidly fixed to the rod 15 of the cylinder 13. Thus, actuation of cylinder 13 causes selected downward or upward movement of platform 5, as required.

Figure 3:
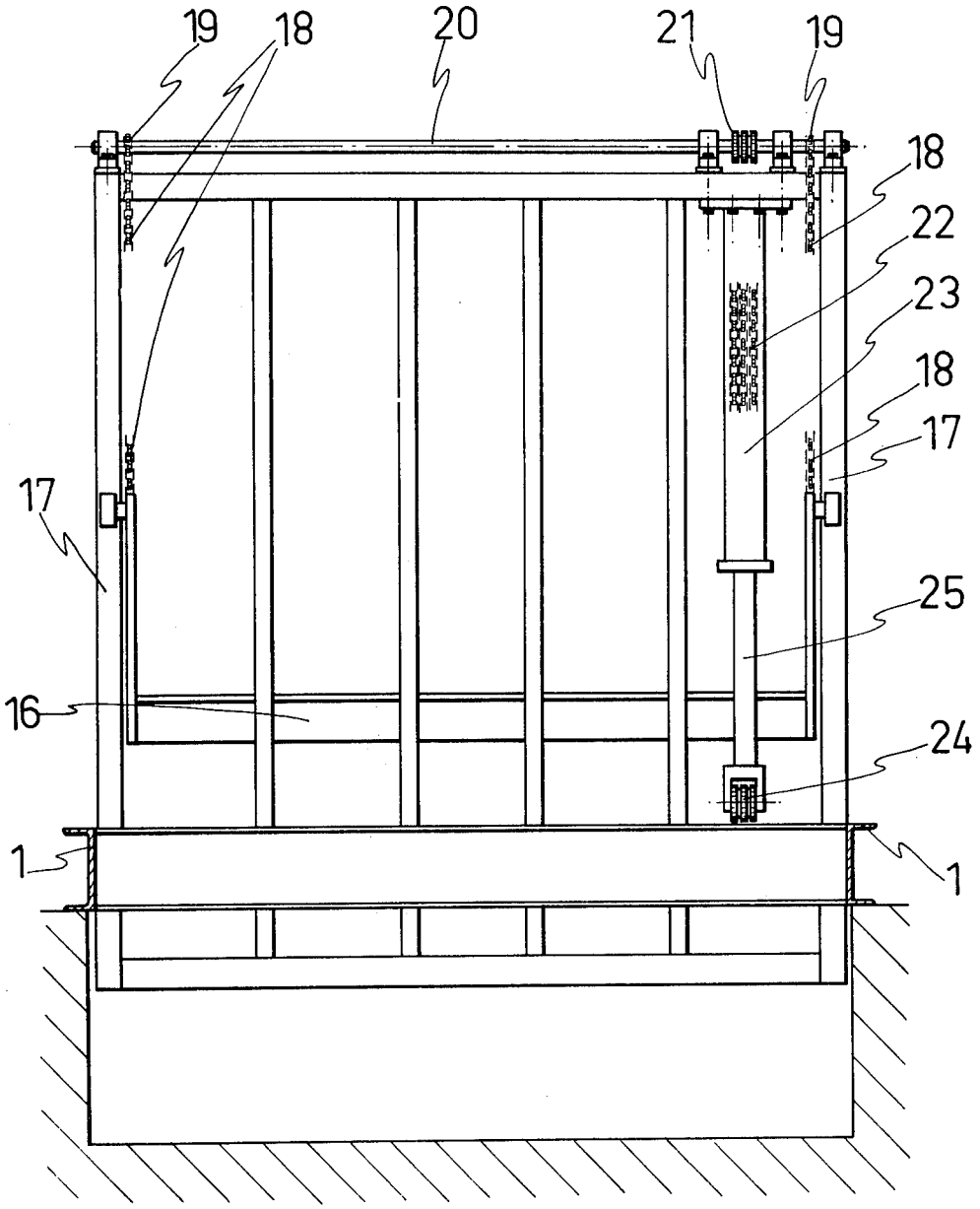
FIG. 3 is a view, taken approximately along line III—III of FIG. 1, of the columns along which the descending platform slides, as well as the drive mechanism therefor.

On the other hand, after the sheets are turned and transferred to descending platform 16, in a manner to be described below, the descending platform 16 is displaced with a rectilinear movement downwardly along the columns 17 by a chain transmission system which is similar to the system of the ascending platform 5 and which, as can be seen in FIG. 3, includes suspension chains 18, meshing pinions 19 solidly fastened to the shaft 20 which, in turn, has solidly fixed thereto a triple gear 21 which meshes with a triple chain 22 driven by the cylinder 23 through the triple pinion 24 solidly fastened to the rod 25.

The mentioned platform 16 which descends as the loose sheets are accumulated thereon, will be displaced to the lower end of the guides 17 and is thus inclined with respect to the chassis 1. Once descent of the platform 16 has been completed, the frame 3 supporting platform 16 will be tilted about axis 4 until it is situated parallel to the ground, i.e. a parallel to chassis 1, at which time the stack of turned sheets 7 can be collected by a conventional trolley. Tilting of the columns 17 about the axis 4 will be carried out by means of the conventional elevator mechanisms.

The arrangement for turning the sheets includes a turning bridge formed of a conveyor belt 26 driven by a shaft 27 by means of pulleys 2 which are joined thereto, at the same time as shaft 27 is driven, via a chain 29, by an adjustable speed motor 30.

Facing the reverser wheel 31 which reverses the direction of movement of the conveyor belt 26, there is provided a system for sending an airjet at the sheets of paper to be turned, and to thereby facilitate such turning. This airjet can either be created by a ventilator or by an injector 32.

A frame is provided to facilitate the entry of each one of the sheets to the conveyor belt 26 so that turning of the sheets can take place. Entry is carried out swiftly and the sheets enter the belt 26 sequentially, The frame is formed of a U-shaped member 33 anchored at the top to the columns 2. Frame 33 acts as a support for a suction pump-actuator and adjusts the position thereof by movement along the frame 33 to a desired position dependent on the length of the sheets to be turned.

Figure 4:
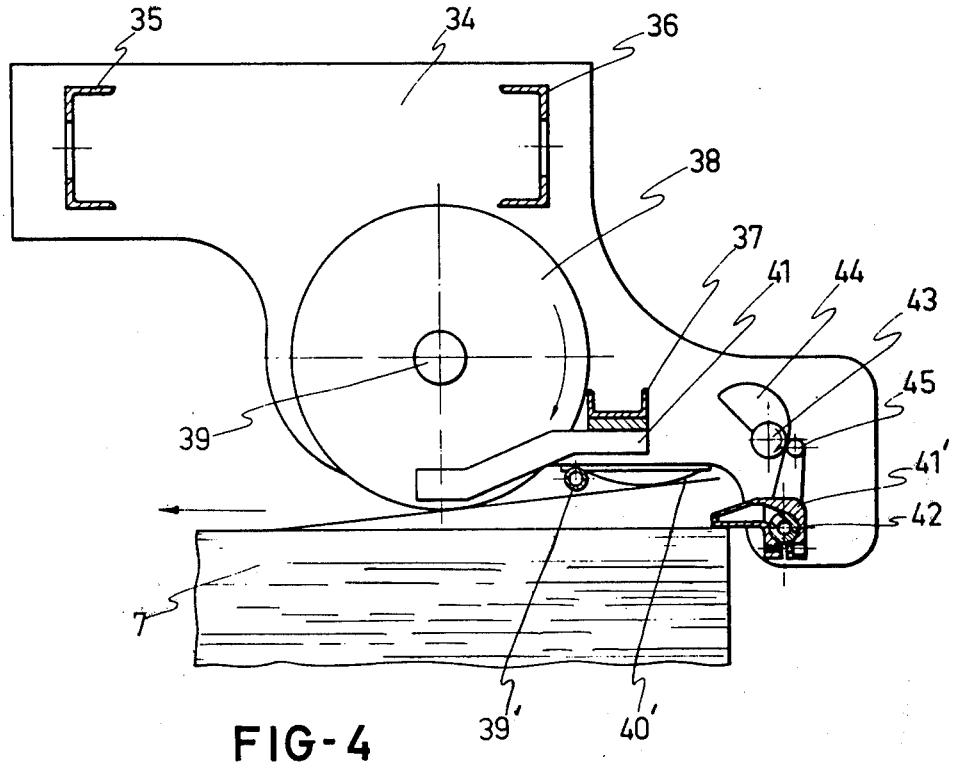
FIG. 4 is a longitudinal section of the sheet transfer carriage.
Figure 5:
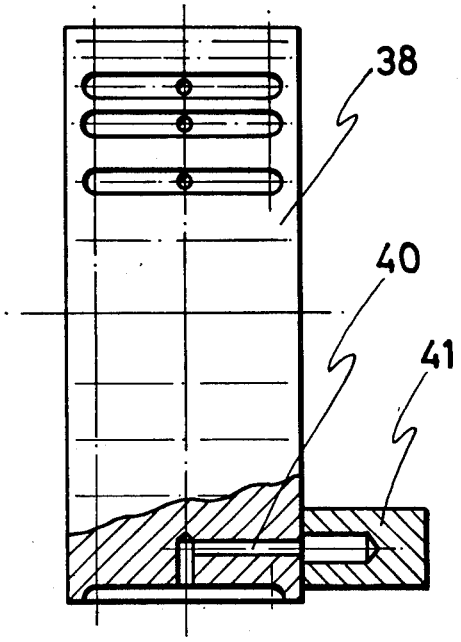
FIG. 5 is a plan view of a vacuum cylinder or wheel.

FIG. 4 illustrates the suction pump-actuator a section of the carriage including side plates 34 joined by means of cross members 35, 36 and 37, and, at the center thereof, cylinders or wheels 38 which rotate about a common axis 39 and which are connected by means of holes 40 to vacuum conduits 41 connected to a compressor to create a draft on the rim of wheels 38 to attract the top sheet of the stack. The carriage is provided with a conduit 39′ through which air under pressure passes to a convex plate 40′ fixed thereto to create a different pressure on the surface of plate 40′ so that an end of the top sheet is attracted thereto and is adapted to the curvature thereof.

The carriage is also provided with an injector socket 41′ capable of rotating about a hollow axis 42 thereof through which air under pressure is injected. Turning of socket 41′ about axis 42 is determined by the actuation of an axis 43 provided with a cam 44 which acts on a follower 45 fixed to axis 42.

The arrangement is such that when the sheet is attracted by the vacuum wheels 38 which rotate about axis 39, and when the sheet is raised at its end by the action of the air from conduit 39′, injector 41′ injects air toward the raised end of the sheet, and the sheet is driven towards the conveyor belt 26.

This system, irrespective of the thickness of the sheets, enables only one sheet to be passed to the conveyor belt.

Functioning of the machine is as follows. The stack of paper 7 which is to be turned is arranged on platform 5, and the compressor or vacuum pump is placed in operation. The vacuum cylinders 38 are made to turn, which will act with the current of the air from the conduit 39' and the injector 41', driving the top sheet towards the conveyor belt 26 which will drive the sheet until it is turned and inverted by wheel 31. Turning is enhanced by the current of frontal air created by the ventillator or injector 32. The thus turned sheets are successively deposited on the platform 16 until the stack 7 passes completely from ascending platform 5 to descending platform 16, which will continue descending by means of the above described drive system until it reaches the lower ends of the guides 17. Then, the frame 3 is tilted about the axis 4 until it is situated parallel to the ground, from which position the stack of turned sheets may be collected by a conventional trolley.

I claim:

1. A machine for inverting or turning over material in sheet form, said machine comprising:

a chassis;

first substantially vertical guide means supported by said chassis;

first platform means, guided for movement along said first guide means, for supporting a stack of sheets to be inverted;

a frame pivoted to said chassis, said frame supporting second guide means, said frame being pivotable from a first position whereat said second guide means is inclined to the vertical to a second position whereat said second guide means is substantially vertical;

second platform means, guided for movement along said second guide means, for supporting said stack of sheets after they have been inverted;

means for moving said first platform means in an ascending direction along said first guide means, and for thereby sequentially moving said stack of sheets to a removal position located above said first platform means;

means, located at said removal position, for sequentially removing the topmost sheet from said stack of sheets and transferring the thus removed sheets to an inverting position located above said second platform means;

means, located at said inverting position, for sequentially receiving said removed sheets from said removing and transferring means, for inverting said sheets, and for sequentially depositing the thus inverted sheets onto said second platform means, when said frame is in said first position thereof, said receiving, inverting and depositing means comprising an endless belt having an upper substantially horizontal run for receiving said sheets from said removing and transferring means and a lower run directed substantially perpendicularly to said second guide means when said frame is in said first position thereof, a roller about which said endless belt passes between said upper and lower runs thereof to invert said sheets, and air generator means for directing a jet of air toward a sheet on said endless belt and passing around said roller to thereby maintain said sheet in contact with said endless belt; and means for moving said second platform in a descending direction along said second guide means, and for thereby sequentially moving said stack of sheets after inversion thereof away from said inverting means.

2. A machine as claimed in claim 1, wherein said first guide means comprises a pair of guide columns extending vertically upwardly from said chassis, and said second guide means comprises a pair of guide columns fixed to and extending perpendicularly from said frame.

3. A machine as claimed in claim 1, wherein said removing and transferring means comprises suction roller means for separating the topmost sheet from said stack of sheets and transferring said topmost sheet toward said upper run of said endless belt.

* * * * *